US005220355A

United States Patent [19]

Miyawaki

[11] Patent Number: 5,220,355

[45] Date of Patent: Jun. 15, 1993

[54] RESISTIVE SHEET THERMAL TRANSFER PRINTER

[75] Inventor: Katsuaki Miyawaki, Yokohama, Japan

[73] Assignee: Ricoh Company, Ltd., Tokyo, Japan

[21] Appl. No.: 864,597

[22] Filed: Apr. 7, 1992

[30] Foreign Application Priority Data

Apr. 10, 1991 [JP] Japan ..... 3-104625
Dec. 24, 1991 [JP] Japan ..... 3-356187

[51] Int. Cl.[5] ..... B41J 29/17; B41J 2/39

[52] U.S. Cl. ..... 346/76 PH; 400/120; 400/701; 400/702; 400/702.1

[58] Field of Search ..... 400/120, 120 SE, 701, 400/702, 702.1; 346/76 PH

[56] References Cited

U.S. PATENT DOCUMENTS 4,624,593 11/1986 Humphries et al. ..... 400/702
4,684,960 8/1987 Nishiwaki ..... 346/76 PH
5,079,566 1/1992 Mori ..... 346/76 PH

FOREIGN PATENT DOCUMENTS 3502535 8/1985 Fed. Rep. of Germany ..... 400/701
1-216878 8/1989 Japan .
1-225574 9/1989 Japan .
0039952 2/1990 Japan ..... 400/120 SR

OTHER PUBLICATIONS

Bowlds et al., "Automatic Printhead Cleaner", IBM Bulletin, vol. 26, No. 3B, Aug. 1983, pp. 1586-1587.

*Primary Examiner*—Benjamin R. Fuller
*Assistant Examiner*—Huan Tran
*Attorney, Agent, or Firm*—Cooper & Dunham

[57] ABSTRACT

A resistive sheet thermal transfer printer includes a plurality of recording electrodes in in contact with a resistance layer of a current sensitized ink sheet, a common electrode in contact with the resistance layer of the current sensitized ink sheet, and a power supply for applying a voltage across the common electrode and each of the recording electrodes in accordance with image data. The resistive sheet thermal transfer printer also includes, a detection circuit for detecting an electrical current passing through each of the recording electrodes when a predetermined voltage is supplied to each of the recording electrodes, a control circuit for determining, based on a detected electric current obtained by the detection circuit, whether or not a deposit has accumulated on at least one of the recording electrodes, and an abrasive mechanism for abrading ends of the recording electrodes when the control circuit determines that the deposit has accumulated on at least one of the recording electrodes.

10 Claims, 6 Drawing Sheets

RESISTIVE SHEET THERMAL TRANSFER PRINTER

BACKGROUND OF THE INVENTION (1) Field of the invention

The present invention generally relates to a resistive sheet thermal transfer printer used in an output device of a computer system, a facsimile machine and so on. The present invention more particularly relates to a resistive sheet thermal transfer printer in which deposit adhered to recording electrodes can be removed.

(2) Description of related art

In a general resistive sheet thermal transfer printer, an ink sheet having a resistance layer, a conductive layer and an ink layer is fed under a condition in which recording electrodes are in contact with the resistance layer of the ink sheet. As a result, deposit of carbon materials forming the resistance layer is accumulated on and around the recording electrodes. Thus, the recording electrodes are worn out by the deposit. If this state is continued, electrical characteristics, representing states in which the recording electrode are in contact with the resistance layer, deteriorate.

To solve the above problem, the following conventional art has been proposed.

Japanese Patent Laid Open Publication 1-216878 discloses a "lapping film cassette".

The lapping film cassette has a lapping film wound around a supplying core and a take-up core. When the supplying core and the take-up core are rotated in a predetermined direction, the lapping film is supplied from the supplying core to the take-up core. The lapping film, the supplying core and the take-up core are housed in a cassette case. The cassette case also houses a mechanism (a cam mechanism) for reciprocating the supplying core and the take-up core in a direction parallel to a direction in which the lapping film is moved.

When a user wishes to abrade the recording electrode, a cassette including the printing ink sheet is replaced with lapping film cassette. The lapping film then is moved, so that the recording electrodes are abraded by the lapping film.

In the above case where the recording electrodes are abraded by the lapping film, the cassette including the printing ink sheet must be replaced with the lapping film cassette. That is, a changing operation of the cassette must be carried out.

Japanese Patent Laid Open Publication 1-225574 discloses a printer in which the recording electrodes can be abraded without changing the cassette including the ink sheet.

In this conventional printer, an ink sheet having a resistance layer, a conductive layer and an ink layer is fed under a condition in which an electrode base and a plurality of recording needles (electrodes) are in contact with the resistance layer of the ink sheet. An image voltage is applied, in accordance with image information, across the electrode base and each of the recording needles. The printer further includes an abrasive mechanism for abrading at least the recording needles, a transferring mechanism for transferring ink from the ink sheet to a recording paper sheet, and a control unit for supplying a control signal, corresponding to the number of recording paper sheets to which ink is transferred, to the abrasive mechanism. The amount of abrasion with which the abrasive mechanism abrades the recording needles is controlled by the control signal.

That is, the amount of abrasion of the recording needles is controlled based on the number of recording paper sheets on which images are printed.

Due to an activation of a recording needle (electrode), deposit can be accumulated on and around the recording needle. That is, the amount of ink transferred to the recording paper sheets corresponds to the amount of deposit accumulated on and around the recording needles. However, as the amount of ink transferred to the recording sheet varies in accordance with image data, the total number of recording sheets on which images are printed does not accurately correspond to the amount of deposit accumulated on and around the recording needles (the recording electrodes). Thus, in the above conventional printer, the recording needle can not be effectively abraded.

SUMMARY OF THE INVENTION

Accordingly, a general object of the present invention is to provide a novel and useful resistive sheet thermal transfer printer in which the disadvantages of the aforementioned prior art are eliminated.

A more specific object of the present invention is to provide a resistive sheet thermal transfer printer in which recording electrodes can be effectively abraded.

The above objects of the present invention are achieved by a resistive sheet thermal transfer printer for printing a dot image by using a current sensitized ink sheet having a resistance layer, a conductive layer and an ink layer, said printer comprising: a plurality of recording electrodes in contact with the resistance layer of said current sensitized ink sheet; a common electrode in contact with the resistance layer of said current sensitized ink sheet; power supply means, coupled to said recording electrodes and said common electrode, for applying a voltage across said common electrode and each of said recording electrodes in accordance with image data, so that an electric current flowing through each of said recording electrodes and into said current sensitized ink sheet, ink being transferred from the ink layer to a recording sheet by heat generated in the resistance layer when the electric current flows into said resistive ink sheet; detection means, coupled to said recording electrodes for detecting an electrical current passing through each of said recording electrodes when a predetermined voltage is supplied to each of said recording electrodes; determination means, coupled to said detection means, for determining whether or not a deposit is accumulated on at least one of said recording electrodes based on a detected electric current obtained by said detection means; and abrasive means, coupled to said determination and said recording electrodes, for abrading ends of said recording electrodes when said determination means determines that the deposit is accumulated on at least one of said recording electrodes.

According to the present invention, when it is determined that the deposit is accumulated on at least one of the recording electrodes based on the measured electric current flowing each of the recording electrodes, the ends of the recording electrodes are abraded. Thus, the recording electrodes can be effectively abraded. In addition, reliability of the recording electrodes can be improved.

Additional objects, features and advantages of the present invention will become apparent from the following detailed description when read in conjunction with the accompanying drawings.

DESCRIPTION OF THE PREFERRED EMBODIMENTS

A description will now be given, with reference to FIG. 1, of the principle of a recording process performed in a resistive sheet thermal transfer printer according to the present invention.

Figure 1:
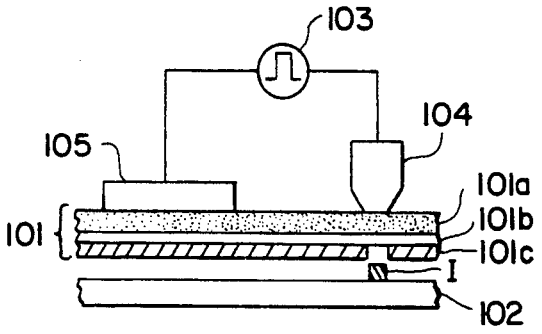
FIG. 1 is a diagram illustrating the principle of a recording process performed in a resistive sheet thermal transfer printer.

Referring to FIG. 1, an ink sheet 101 is formed of a resistance layer 101*a*, a conductive layer 101*b* and an ink layer 101*c*, which layers are stacked. The ink sheet 101 is fed in a predetermined direction. A common electrode 105 and each of recording electrodes 104 are in contact with the resistance layer 101*a* of the ink sheet 101. The recording electrodes 103 are arranged in a plane in a direction perpendicular to the direction in which the ink sheet 101 is moved. An area that the common electrode 105 is in contact with the resistance layer 101*a* is extremely greater than an area that each of the recording electrodes 104 is in contact with the resistance layer 101*a*. A signal source 103 applies a pulse signal voltage across the common electrode 105 and each of the recording electrodes 104 in accordance with image data. The ink sheet 101 is put on the a recording sheet 102 which is moved along with the ink sheet 101.

In the above printer, when the pulse signal voltage is applied across the common electrode 105 and each of the recording electrodes 104, an electric current supplied from each of the recording electrodes 104 flows through a first part of the resistance layer 101*a* with which each of the recording electrodes 104 is in contact, the conductive layer 101*b* between the common electrode 105 and each of the recording electrodes 104 and a second part of the resistance layer 101*a* with which the common electrode 105 is in contact. As an area of the first part of the resistance layer 101*a* is extremely less than an area of the second part of the recording layer 101*a*, a current density in the first part of the resistance layer 101*a* is extremely greater than a current density in the second part of the resistance layer 101*a*. Thus, due to heat generated in the first part of the resistance layer 101*a*, ink, in the ink layer 101*c*, corresponding to each of the recording electrodes 104 is melted or softened, so that the melted or softened ink I is transferred from the ink layer 101*c* to the recording sheet 102. The ink transferred to the recording sheet 102 is then fixed there on, so that a dot image is formed on the recording sheet 102.

A description will now be given of a first embodiment of the present invention with reference to FIGS. 2 through 7.

Figure 2:
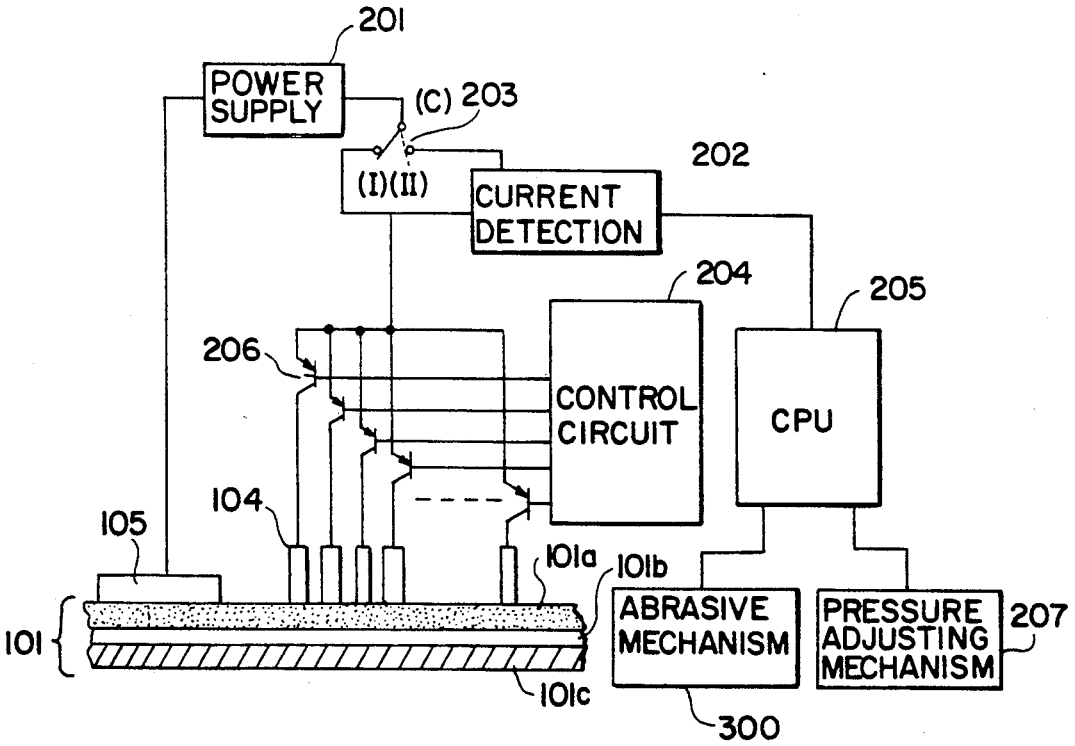
FIG. 2 is a diagram illustrating a resistive sheet thermal transfer printer according to a first embodiment of the present invention.

Referring to FIG. 2, which shows a resistive sheet thermal transfer printer, a plurality of recording electrodes 104 and a common electrode 105 are in contact with an ink sheet 101 in the same manner as those shown in FIG. 1. The ink sheet 101 has a resistance layer 101*a*, a conductive layer 101*b* and an ink layer 101*c*. Each of the recording electrodes 104 is connected to a switching transistor 206. Each switching transistor 206 is controlled so as to be turned on and off in accordance with a control signal supplied from a control circuit 204. The control circuit 204 outputs the control signal corresponding to a recording signal generated by a CPU (Central Processing Unit) 205 in accordance with image data. An electric power supply 201 has an output terminal and a grand terminal. The grand terminal is connected to the common electrode 105. A switch 203 has a common terminal (C) connected to the output terminal of the electric power supply 201, a first terminal (I) and a second terminal (II). The first terminal (I) is connected to each of the switching transistors 206, so that when the switch selects the first terminal (I) an output voltage from the electric power supply 201 is supplied, via the switch 203 and switching transistors 206, which are turned on, to corresponding recording electrodes 204. The second terminal (II) of the switch 203 is connected to a current detection circuit 202, so that when the switch selects the second terminal (II) the output voltage from the electric power supply 201 is supplied via the switch 203 to the current detection circuit 202. The current detection circuit 202 is activated when the output voltage is supplied from the electric power supply 201. The current detection circuit 202 then detects the amount of electric current flowing through each of the recording electrodes corresponding to switching transistors 206, which are turned on. The current detection circuit 202 outputs a detection signal corresponding to the amount of electric current flowing through each of the recording electrodes. The detection signal is supplied from the current detection circuit 202 to the CPU 205. The CPU 20 generates driving control signals based on the detection signal supplied from the current detection circuit 202. In a case where the switch 203 selects the terminal (II), the CPU 205 supplies a test driving signal to the control circuit 204. Then the control circuit 204 supplies test signals to the switching transistors 206 so that the switching transistors 206 are successively turned on and off.

In a case of printing, the switch 203 selects the terminal (I). The switching transistors 206 are turned on and off in accordance with the control signal corresponding to the recording signal output from the CPU 205. An electric current is supplied from each of recording electrodes 104, connected to the switching transistors which are turned on, to the ink 101, so that a part of resistance layer 101*a* corresponding to each of the recording electrodes 104 generates heat. As a result, ink corresponding to each of the recording electrodes 104 is transferred to the recording sheet 102.

In a case of testing, the switch 203 selects the terminal (II). The output voltage is supplied from the electric power supply 201 to the switching transistors 206 via the current detection circuit 202. In this state, the test signals are successively supplied from the control circuit 204 to the switching transistors 206, so that the switching transistors 206 are successively turned on and off. Thus, electric currents successively flow through the recording electrodes 104. An electric current flowing through each of the recording electrodes 104 is measured by the current detection circuit 202. Current value data representing a value of the measured electric current is supplied from the current detection circuit 202 to the CPU 205. In the CPU 205, the current value data is compared with a predetermined threshold level. If a small space is exists between any of the recording electrodes 104 and the ink sheet 101 due to the deposit accumulated on the end of each of the recording electrodes 104, an electric discharge can occur in the small space. When the electric discharge occurs in the small space, a huge current flows through a corresponding recording electrode. Thus, in a case where the current value data corresponding to at least one of the recording electrodes 104 is greater than the threshold level, it is determined that the deposit has accumulated on and around at least one of the recording electrodes 104. In this case, an abrasive mechanism 300 is activated by the CPU 205 so that ends of the recording electrodes 104 are abraded by the abrasive mechanism 300 in a process to be detailed later.

After the recording electrodes 104 are abraded by the abrasive mechanism 300, the CPU 205 controls a pressure adjusting mechanism 207 for adjusting a contact pressure of the recording electrodes 104 on the ink sheet 101.

Figure 3:
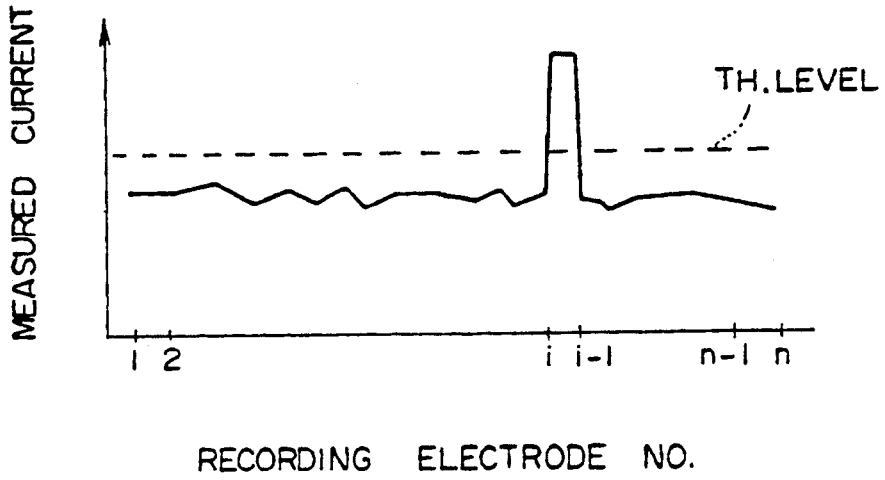
FIG. 3 is a graph illustrating the amount of electric current flowing through each recording electrode, which current is measured by a current detection circuit shown in FIG. 2.

FIG. 3 is a graph showing an example of electric currents measured by the current detection circuit 202. Each of the electric currents shown in FIG. 3 relates to one of n recording electrodes 104 (1−n). A dashed line shown in FIG. 3 represents a threshold level. In FIG. 3, electric currents flowing through the i-th recording electrode and the (i+1)-th recording electrode are greater than the threshold level. Thus, the CPU 205 determines that an electric discharge has occurred at the i-th and (i+1)-th recording electrodes. When CPU 205 determines that there is no electric discharge, based on the result obtained by the current detection circuit 202, the printing is continued. Alternatively, when the CPU 205 determines that there is an electric discharge, an abrasion process for abrading the ends of the recording electrodes 104 is carried out.

Figure 4:
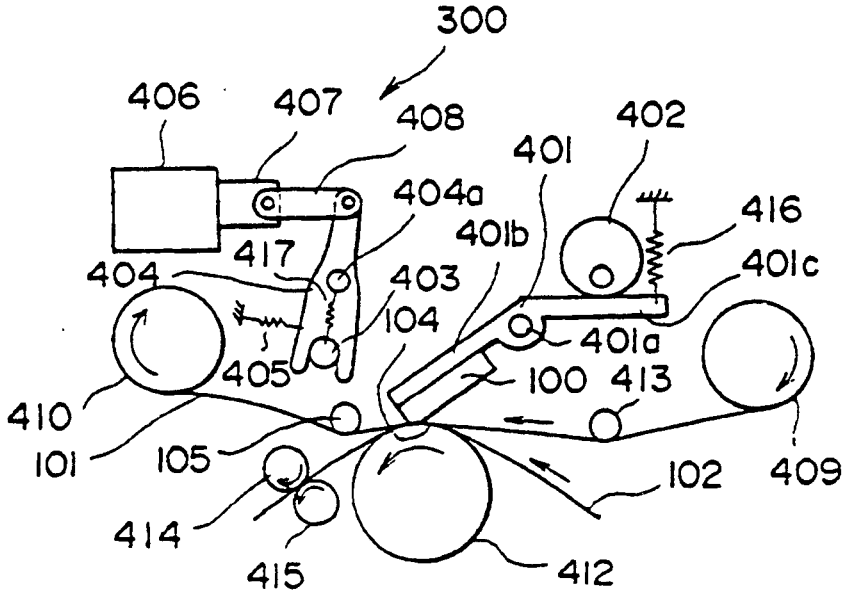
FIG. 4 is a detailed diagram illustrating an abrasive mechanism shown in FIG. 2.

A mechanism for printing is formed, for example, as shown in FIG. 4.

Referring to FIG. 4, a head bracket 401 is rotatably supported by a shaft 401*a* (movable only in a vertical direction). The head bracket 401 has a first arm 401*b* and a second arm 401*c*. The first and second arms 401*b* and 401*c* of the head bracket 401 respectively extend from a supporting point thereof in nearly opposite directions. A head 100 having the recording electrodes 104 is mounted on the first arm 401*b* of the head bracket 401. A cam 402 is in contact with the second arm 401*c* of the head bracket 401. A spring 416 is provided at an end of the second arm 401*c* of the head bracket 401 so that a force is applied to the head bracket 401 for rotating the head bracket 401 around the shaft 401*a* in a counterclockwise direction. Due to the force of the spring 416, in a normal state, ends of the recording electrodes 104 presses an ink sheet 101 against a platen roller 412. The ink sheet 101 wound around a supply roller 409 extends to a winding roller 410 and is wound around the winding roller 410. That is, the ink sheet 101 is fed from the supply roller 409 to the winding roller 410. A recording sheet 102 is in contact with the platen roller 412 so as to be partially wound on the platen roller 412 and put between a feed roller 414 and a pinch roller 415, so that the recording sheet 102 is fed by rotation of the platen roller 412, the feed roller 414 and the pinch roller 415 in the same direction as the ink sheet 101. The ink sheet 101 is fed with an appropriate tension being maintained by a tension roller 413. The common electrode 105 is provided at a position on the down stream side of the recording electrodes 104 so as to be in contact with the ink sheet 101.

In the above mechanism for printing, the ink is transferred from the ink sheet 101 to the recording sheet 102 in accordance with the principle described above with reference to FIG. 1, so that an image is formed on the recording sheet 102.

Near the head 100 mounted on the head bracket 401, the abrasive mechanism 300 is provided .

Figure 5:
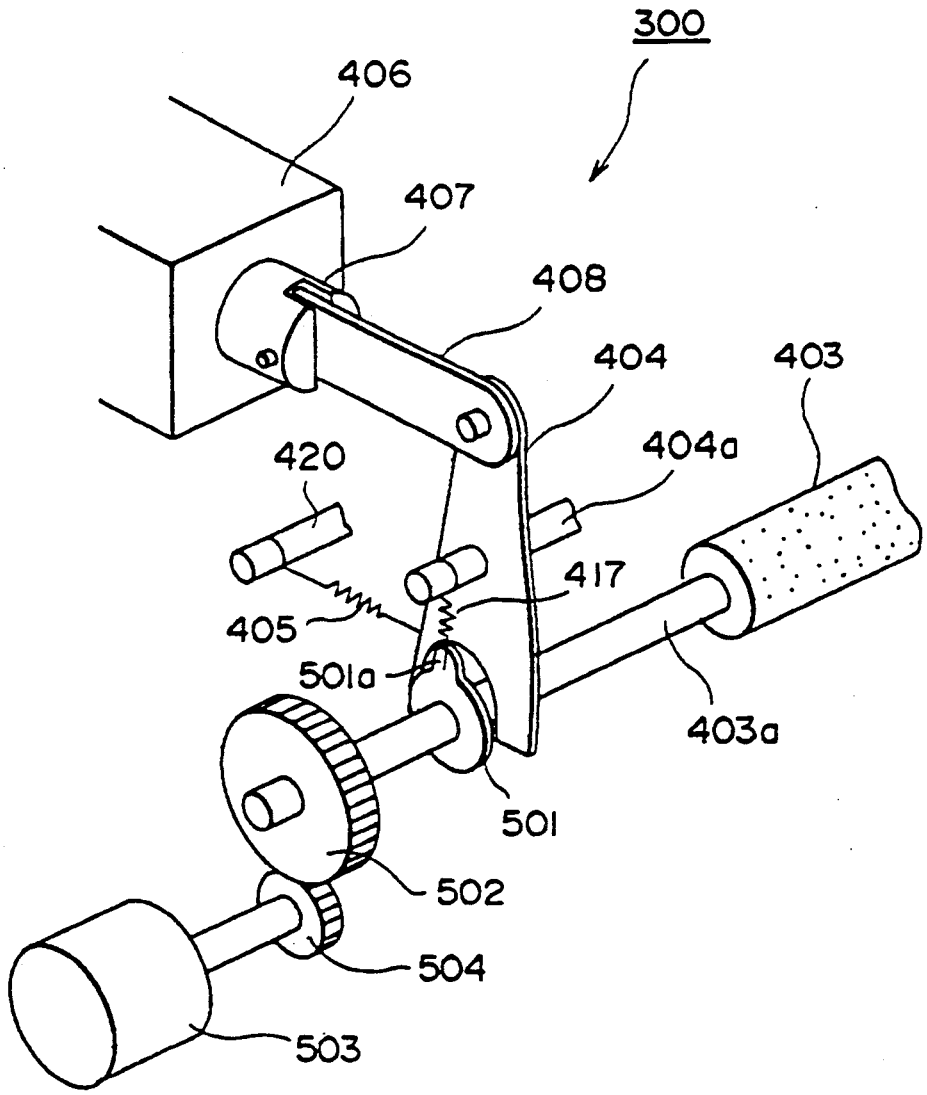
FIG. 5 is a detailed diagram illustrating a driving mechanism of an abrasive roller shown in FIG. 4.
Figure 6:
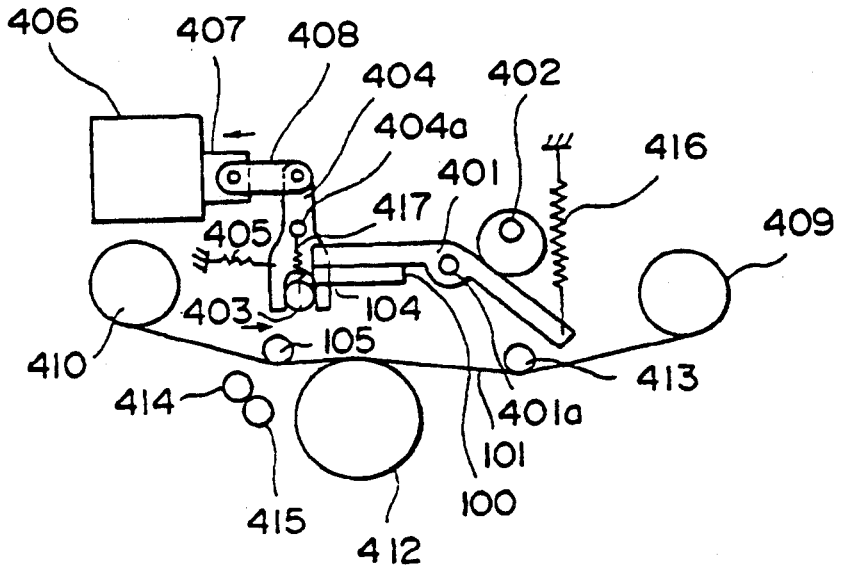
FIG. 6 is a diagram illustrating an operation of the abrasive mechanism shown in FIG. 4.

The abrasive mechanism 300 has an abrasive roller 403 for abrading ends of the recording electrodes 104, a lever 404 rotatable around a shaft 404*a*, a spring 405 for pulling the lever 404*a* in a direction away from the head 100, a solenoid 406, a plunger 407 pushed and pulled by the solenoid 40 and a rod 408 connecting the plunger 407 and an end of the lever 404. An end of a spring 417 is fixed on the shaft 404*a* so that an abrasive roller assembly (including the abrasive roller 403) is suspended by the spring 417. A detailed structure of the abrasive mechanism 300 is shown in FIG. 5. Referring to FIG. 5, the abrasive roller assembly is formed on the abrasive roller 403, a roller shaft 403*a*, a bearing 501 and a driven gear 502. The abrasive roller 403 is coaxially mounted on an end of the roller shaft 403*a*. The roller shaft 403*a* is rotatably engaged with and supported by the bearing 501. The bearing 501 has a projection part 501*a* projecting from an edge thereof. Another end of the spring 417 is fixed on the projection part 501*a* of the bearing 501. The driven gear 502 is coaxially mounted on another end of the roller shaft 403*a*. A driving gear 504 mounted on a motor shaft of a driving motor 503 is engaged with the driven gear 502. A spring 405 is provided between the lever 404 and a pin 420 fixed on a housing so that the lever 404 is pulled thereby. The surface of the abrasive roller 403 is provided with an abrasive material, such as diamond or grindstone.

A detailed description will now be given of an operation for abrading the recording electrodes 104.

In a testing mode before or after a printing operation, when it is determined that the electric discharge has occurred at one of the recording electrodes 104, as shown in FIG. 3, the cam 402 is rotated by a half cycle so that the cam 402 pushes down the second arm 401*a* of the head bracket 401. Thus, the head bracket 401 is rotated around the shaft 401*a* in a clockwise direction, so that the head 100 is separated from the ink sheet 101 and set at a position such that the recording electrodes may be abraded (an abrasive position hereto forward) a shown in FIG. 6. After this, the solenoid 406 is turned on in accordance with an instruction from the CPU 205. When the solenoid 406 is turned on, the plunger 407 is pulled by the solenoid 406, so that the lever 404 rotates around the shaft 404 in a counterclockwise direction. Thus the abrasive roller 403 is brought into contact with the ends of th recording electrodes 104 in the head 100 which has been positioned at the abrasive position. In this state, the driving motor 503 is activated for a predetermined time, so that the abrasive roller 403 is rotated for the predetermined time. While the abrasive roller 403 is being rotated, the ends of the recording electrodes 104 in the head 100 are abraded by the abrasive roller 403. As a result, the deposit accumulated on and around the ends of the recording electrodes 104 is removed.

After the abrasive roller 403 is rotated for the predetermined time, the solenoid 406 is turned off, so that the abrasive roller 403 is separated from the ends of the recording electrodes 104. Then the cam 402 is reversed by a half cycle, so that the head 100 returns to a position at which the recording electrodes 104 are in contact with the ink sheet 101. In this state, the test signals are successively supplied from the control circuit 204 to the switching transistors 206. While the test signals are being supplied to the switching transistors 206, the current detection circuit 202 measures an electric current flowing through each of the recording electrodes 104. The CPU 205 controls the pressure control mechanism 207 so that the electric current measured by the current detection circuit 202 becomes a predetermined initial value. The pressure control mechanism 207 includes a mechanism for moving the shaft 401*a* of the head bracket 401 in a vertical direction. When the shaft 401*a* of the head bracket 401 is moved so as to be brought close to the ink sheet 101, the contact pressure of the recording electrodes 104 on the ink sheet 101 is increased. When the shaft 401*a* of the head bracket 401 is moved away from the ink sheet 101, the contact pressure of the recording electrodes 104 on the ink sheet is decreased. The electric current flowing through each of the recording electrodes 104 varies proportionally with the contact pressure of the recording electrodes 104 on the ink sheet 101. As a result, a density of printing dot can be controlled and made stable.

The cam 402 can be also used as the pressure control mechanism 207. In this case, the contact pressure of the recording electrodes 104 on the ink sheet 101 is controlled in accordance with an angular displacement of the cam 402.

Figure 7A:
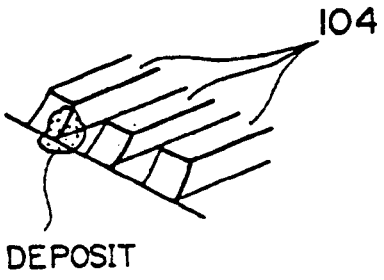
FIGS. 7A and 7B are enlarged diagrams illustrating ends of recording electrodes.
Figure 7B:
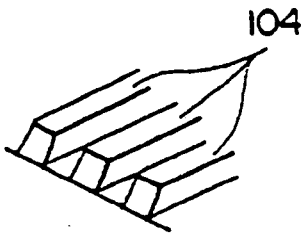

While the printing process is repeatedly carried out, deposit of carbon materials is accumulated on and around the recording electrodes 104 as shown in FIG. 7A. Then when the electric discharge has occurred due to the deposit accumulated on one or plurality of the recording electrodes 104, the ends of the recording electrodes 104 are abraded by the abrasive mechanism 300, so that the deposit is removed from the ends of the recording electrodes 104, as shown in FIG. 7B.

Figure 8:
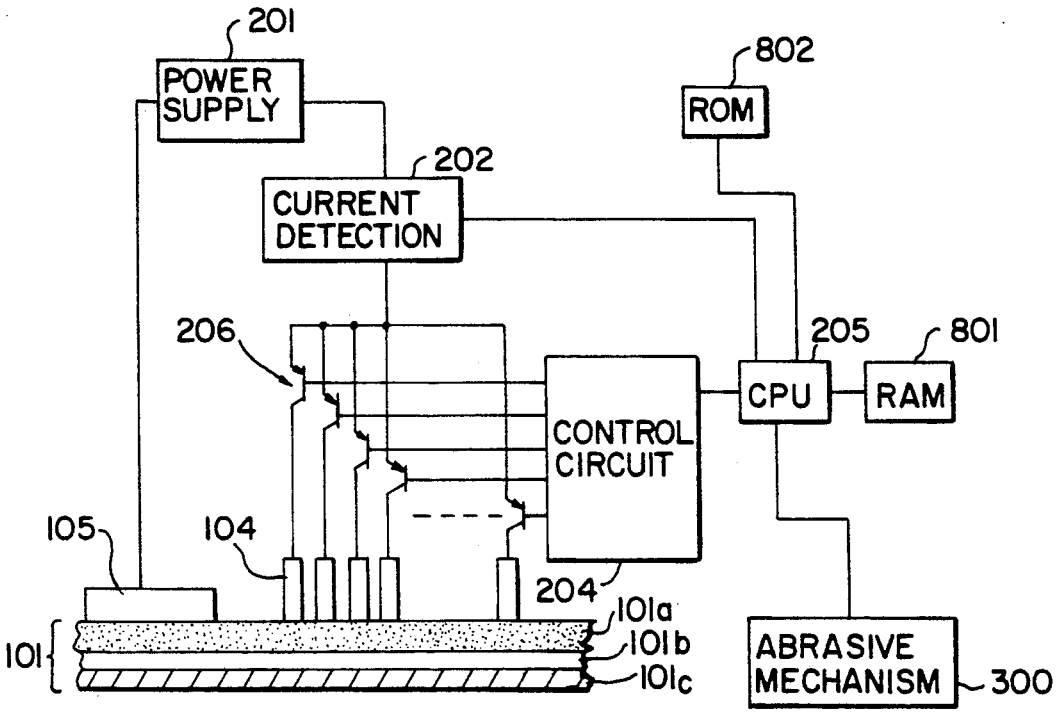
FIG. 8 is a diagram illustrating a resistive sheet thermal transfer printer according to a second embodiment of the present invention.

A description will now be given of a second embodiment of the present invention with reference to FIG. 8. In FIG. 8, those parts which are the same as those shown in FIG. 2 are given the same reference numbers. In the second embodiment, an electric current flowing through each of the recording electrodes is measured when printing images. Thus, the switch 203 of FIG. 2, for selecting between a testing or a printing mode is not used in the second embodiment.

Referring to FIG. 7, a RAM (Random Access Memory) 801 and a ROM (Read Only Memory) 802 are coupled to the CPU 205. Image data for printing is stored in the RAM 802. Reference current data is stored in the ROM 801, it is used for determining whether or not there is an electric current leakage (an electric discharge) at any of the recording electrodes 104. The ground terminal of the power supply 201 is connected to the common electrode 105, and the output terminal of the power supply 201 is coupled to each of the switching transistors 206 via the current detection circuit 202. Thus, the output voltage from the power supply 201 is supplied to each of the recording electrodes 104 via the current detection circuit and a corresponding one of the switching transistors 206.

When a printing process starts, the image data for printing is supplied form the RAM 801 to the CPU 205, and the printing signal corresponding to the image data for printing is supplied form the CPU 205 to the control circuit 204. The control circuit 204 drives each of the switching transistors 206 in accordance with the printing signal. Due to the driving of each of the switching transistors 206, an electric current corresponding to the image data for printing flows through each of the recording electrodes 104. The ink corresponding to each recording electrode through which the electric current flows is transferred from the ink sheet 101 to the recording sheet 102. As a result, an image corresponding to the printing image data is formed on the recording sheet.

While printing an image for one line, the current detection circuit 202 measures the amount of electric current flowing through each of the recording electrodes 104. The CPU 205 determines whether or not the amount of electric current measured by the current detection circuit 202 is less than a predetermined reference value. When the amount of electric current measured by the current detection circuit 202 is greater than the predetermined reference value, the printing of this line is interrupted. The CPU 205 activates the abrasive mechanism 206, so that the ends of the recording electrodes 104 are abraded by the abrasive mechanism 206 in the same manner as those described in the first embodiment. After this, printing of the next line is carried out.

A description will now be given of the reference value (the threshold level) used for determining whether or not the recording electrodes must be abraded.

If the deposit accumulates on each of the recording electrodes 104, the following three cases can occur.

In a first case, an electric discharge occurs at recording electrodes on which the deposit is accumulated as described above. When the electric discharge occurs, a huge electric current is measured by the current detection circuit 202.

A second case is a case where carbon material deposit accumulates between adjacent recording electrodes so that the adjacent recording electrodes are electrically coupled to each other by the deposit. In the second case, even if the output voltage is supplied from the power supply 201 to only one of the two adjacent recording electrodes so coupled, electric currents of almost the same magnitude flow through both the adjacent recording electrodes. That is, electric current measured by the current detection circuit 202 is almost twice as large as in a normal case.

A third case is a case where a deposit such as a high resistance powder accumulates between a recording electrode and the ink sheet. In the third case, contact resistance of the recording electrode on the ink sheet 101 increases. Thus, when the output voltage is supplied to the recording electrode, an electric current measured by the current detection circuit 202 decreases.

When the reference value (the threshold level) is set to a first relatively high value, it can be determined, only in the first case, that the ends of the recording electrodes need to be abraded. When the measured electric current exceeds the first value (the reference value) set as an upper limit, it is determined that the ends of the recording electrodes need to be abraded.

Figure 9:
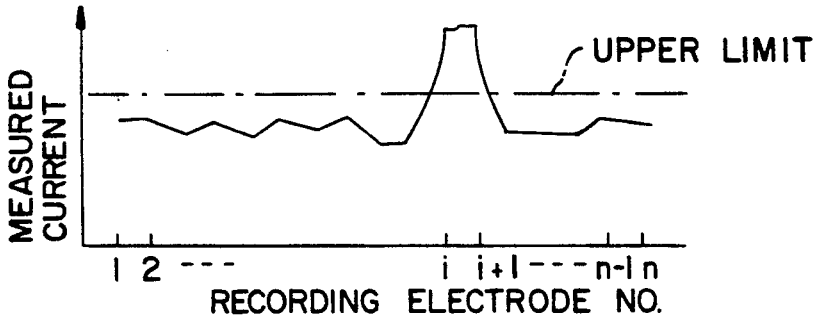
FIG. 9 is a graph illustrating a relationship between an upper limit and the amount of electric current flowing through each recording electrode, the current being measured by a current detection circuit shown in FIG. 8.

When the reference value is set to a second value less than the above first value, it can be determined that the ends of the recording electrodes must be abraded, in the above first and second cases. The second value is, for example, slightly larger than an electric current required for obtaining a maximum image density. When the deposit accumulates between the i-th recording electrode and the (i+1)-th recording electrode in the second case, measured electrical currents corresponding to the i-th and (i+1)-th recording electrodes exceed the second value (the reference value) set as the upper limit, as shown in FIG. 9. In this case, it is determined that the ends of the recording electrodes need to be abraded.

Figure 10:
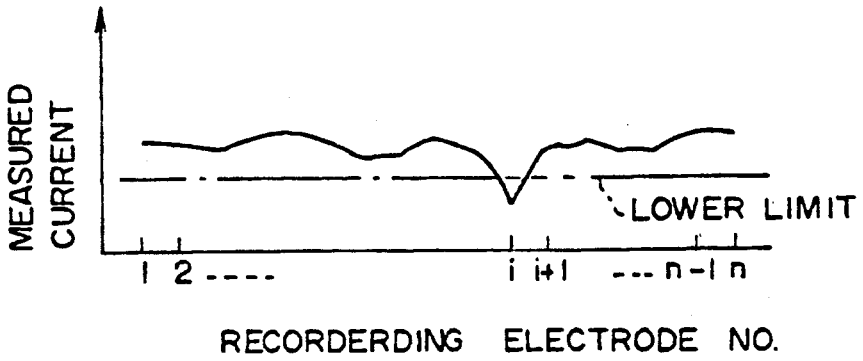
FIG. 10 is a graph illustrating a relationship between a lower limit and the amount of electric current flowing through each recording electrode.

When the reference value is set to a third relatively low value less than the above second value, it can be determined, in the third case, that the ends of the recording electrodes must be abraded. When the deposit accumulates between the j-th recording electrode and the ink sheet in the third case, a measured electric current corresponding to the j-th recording electrode becomes less than the third value (the reference value) set as a lower limit, as shown in FIG. 10. In this case, it is determined that the ends of the recording electrodes needed to be abraded.

Figure 11:
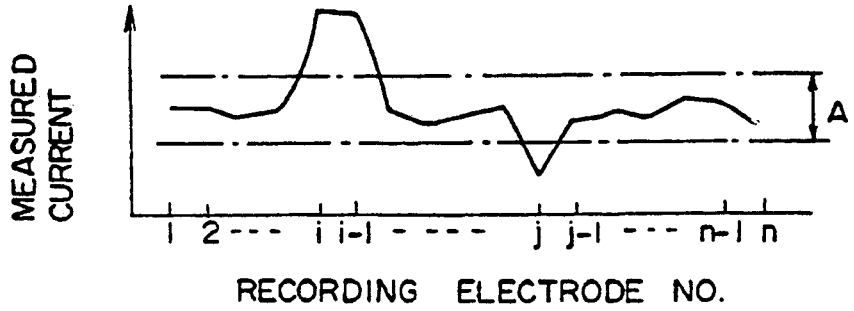
FIG. 11 is a graph illustrating a reference current range (A) and the amount of electric current flowing through each recording electrode.

Hence, it can be determined, by using two reference values, when the ends of the recording electrodes must be abraded. One reference value is set as the upper limit and another reference value is set as the lower limit. It is preferable that the above second value and the above third value be respectively set as the upper and lower limits respectively. In this case, when a measured electric current falls into a range (A) between the lower limit and the upper limit, the printing is continued. Alternatively, when a measured electric current corresponding to the i-th and (i+1)-th recording electrodes exceeds the upper limit, or when a measured electric current corresponding to th j-th recording electrode becomes less than the lower limit, as shown in FIG. 11, the ends of the recording electrodes are abraded.

The determination of the necessity of abrading the recording electrodes based on the lower limit (in cases shown in FIGS. 10 and 11) can be carried out in the testing mode as described in the first embodiment.

The present invention is not limited to the aforementioned embodiment, and variations and modifications may be made without departing from the scope of the claimed invention.

What is claimed is:

1. A resistive sheet thermal transfer printer for printing a dot image by using a current sensitized ink sheet having a resistance layer and an ink layer, said printer comprising:

a plurality of recording electrodes in contact with the resistance layer of said current sensitized ink sheet;

a common electrode in contact with the resistance layer of said current sensitized ink sheet;

power supply means, coupled to said recording electrodes and said common electrode, for applying a voltage across said common electrode and each of said recording electrodes in accordance with image data, so that an electric current flows through each of said recording electrodes and into said current sensitized ink sheet, ink being transferred from said ink layer to a recording sheet by heat generated in the resistance layer when the electric current flows into said resistance layer of said current sensitized ink sheet;

detection means, coupled to said recording electrodes, for detecting an electrical current passing through each of said recording electrodes when a predetermined voltage is supplied to each of said recording electrodes;

determination means, coupled to said detection means, for determining, based on a detected electrical current obtained by said detection means, whether or not a deposit has accumulated on at least one of said recording electrodes; and abrasive means, coupled to said determination means and said recording electrodes, for abrading ends of said recording electrodes when said determination means determines that a deposit has accumulated on at least one of said recording electrodes.

2. A printer as claimed in claim 1, wherein said detection means is activated when an image is printed on the recording sheet.

3. A printer as claimed in claim 1, wherein said detection means is activated in a test mode in which an image is not printed on the recording sheet.

4. A printer as claimed in claim 1, wherein said determination means has first means for detecting the measured electric current exceeding a first reference value, said determination means determining that the deposit has accumulated o at least one of said recording electrodes when said first means detects the measured electric current exceeding the first reference value.

5. A printer as claimed in claim 4, wherein the first reference value is set based on an amount of electric current flowing through a recording electrode when an electric discharge occurs between the recording electrode and said current sensitized ink sheet.

6. A printer as claimed in claim 4, wherein the first reference value is set based on an amount of electric current required for obtaining a dot having a maximum image density.

7. A printer as claimed in claim 1, wherein said determination means has second means for detecting the measured electric current being less than a second reference value, said determination means determining that the deposit is accumulated on at least one of said recording electrodes when said second means detects the measured current being less that the second reference value.

8. A printer as claimed in claim 6, wherein the second reference value is set based on an electric current flowing through a recording electrode when a contact resistance of the recording electrode on said current sensitized ink sheet is increased due to the deposit accumulated between the recording electrode and said current sensitized ink sheet.

9. A printer as claimed in claim 1, said abrasive means comprising:

a first mechanism for separating said recording electrodes from said current sensitized ink sheet;

a abrasive roller;

a second mechanism for bringing said abrasive roller into contact with ends of said recording electrodes which have been separated from said current sensitized ink sheet;

a driving mechanism for rotating said abrasive roller in a state where said abrasive roller is in contact with the ends of said recording electrodes.

10. A printer as claimed in claim 9, further comprising:

pressure adjusting means, coupled to said recording electrodes, for adjusting a contact pressure of said recording electrodes on said current sensitized ink sheet after the ends of said recording electrodes are abraded by said abrasive means, so that an electric current flowing through each of said recording electrodes is maintained at a predetermined value when printing.

* * * * *